US008136436B2

(12) United States Patent
Osborne et al.

(10) Patent No.: US 8,136,436 B2
(45) Date of Patent: Mar. 20, 2012

(54) SAW CHAIN LINK WITH OFFSET FOOTPRINT

(75) Inventors: Ian Osborne, Hillsboro, OR (US); Mike Harfst, Milwaukie, OR (US); Christopher Seigneur, West Linn, OR (US)

(73) Assignee: Blount, Inc., Portland, OR (US)

( * ) Notice: Subject to any disclaimer, the term of this patent is extended or adjusted under 35 U.S.C. 154(b) by 308 days.

(21) Appl. No.: 11/940,201

(22) Filed: Nov. 14, 2007

(65) Prior Publication Data

US 2008/0110317 A1 May 15, 2008

Related U.S. Application Data

(60) Provisional application No. 60/866,004, filed on Nov. 15, 2006, provisional application No. 60/957,427, filed on Aug. 22, 2007.

(51) Int. Cl.
*B26D 1/46* (2006.01)
*B27B 33/02* (2006.01)
*B27B 33/14* (2006.01)

(52) U.S. Cl. ..... 83/830; 83/832

(58) Field of Classification Search ..... 83/830–834, 83/839–845; 144/244, 34.1
See application file for complete search history.

(56) References Cited

U.S. PATENT DOCUMENTS 1,150,218 A 8/1915 Martin
2,642,102 A 6/1953 Dunnington
2,826,226 A 3/1958 Donley
2,857,942 A * 10/1958 Mall ..... 83/833
2,873,775 A * 2/1959 Abbott ..... 83/834
2,891,586 A * 6/1959 Wright ..... 30/383
2,897,857 A * 8/1959 Carlton ..... 83/834
2,902,068 A * 9/1959 Gudmundsen ..... 83/834
3,093,235 A * 6/1963 Imse ..... 198/852
3,170,335 A * 2/1965 Kuntzmann ..... 474/231
3,180,378 A 4/1965 Carlton
3,224,476 A * 12/1965 Chadwick ..... 83/834
3,269,434 A 8/1966 Cooper
3,291,169 A * 12/1966 Morner ..... 30/383
3,444,907 A 5/1969 Chadwick
3,469,610 A * 9/1969 Silvon ..... 83/831
3,473,582 A * 10/1969 Lanz et al. ..... 83/832
3,538,965 A * 11/1970 Stretton et al. ..... 83/830
3,545,508 A * 12/1970 Tupper ..... 83/833
3,844,221 A * 10/1974 Fromme ..... 104/172.5
3,945,288 A * 3/1976 Olmr ..... 83/834
3,968,821 A 7/1976 Jonsson
3,989,076 A * 11/1976 Zurcher ..... 144/42
4,348,927 A 9/1982 Olmr
4,353,277 A 10/1982 Silvon
4,425,830 A 1/1984 Atkinson
(Continued)

FOREIGN PATENT DOCUMENTS

CA 721087 11/1965
(Continued)

*Primary Examiner* — Ghassem Alie
*Assistant Examiner* — Bharat C Patel
(74) *Attorney, Agent, or Firm* — Schwabe Williamson & Wyatt

(57) ABSTRACT

In various embodiments, a saw chain is provided that includes a rail engaging link that has an offset footprint within the link itself and/or with respect to other links in the chain that are adapted to ride on the same rail. Saw chains as provided may be used in a variety of applications, including but not limited to wood cutting and aggregate cutting applications.

18 Claims, 6 Drawing Sheets

U.S. PATENT DOCUMENTS

| | | | | | |
|---|---|---|---|---|---|
| 4,459,890 | A | | 7/1984 | Dolata | |
| 4,558,621 | A | | 12/1985 | Nitschmann | |
| 4,573,386 | A | * | 3/1986 | Lindemann et al. | 83/833 |
| 4,581,968 | A | | 4/1986 | Gibson | |
| 4,604,932 | A | | 8/1986 | Doiron | |
| 4,625,610 | A | | 12/1986 | Petrovich | |
| 4,627,322 | A | | 12/1986 | Hayhurst, Jr. | |
| 4,756,221 | A | | 7/1988 | Nitschmann | |
| 4,934,052 | A | | 6/1990 | Nitschmann | |
| 4,971,022 | A | * | 11/1990 | Scott et al. | 125/21 |
| 5,092,211 | A | * | 3/1992 | Petrovich et al. | 83/830 |
| 5,226,857 | A | | 7/1993 | Ono | |
| 5,257,568 | A | | 11/1993 | Nitschmann | |
| 6,112,632 | A | * | 9/2000 | Buchholtz et al. | 83/830 |
| 6,223,640 | B1 | * | 5/2001 | Sundstrom | 83/830 |
| 6,308,606 | B1 | | 10/2001 | Buchholtz | |
| 6,374,716 | B1 | * | 4/2002 | Weber et al. | 83/833 |
| 6,446,534 | B1 | * | 9/2002 | Harfst | 83/834 |
| 6,748,840 | B2 | | 6/2004 | Harfst | |
| 6,837,138 | B2 | * | 1/2005 | Mang | 83/830 |
| 2005/0115379 | A1 | | 6/2005 | Schulz | |

FOREIGN PATENT DOCUMENTS

| | | |
|---|---|---|
| GB | 2067465 | 7/1981 |

* cited by examiner

SAW CHAIN LINK WITH OFFSET FOOTPRINT

CROSS REFERENCE TO RELATED APPLICATIONS

The present application claims priority to U.S. Provisional Patent Application No. 60/866,004, filed Nov. 15, 2006, entitled "SAW CHAIN LINK WITH TAPER AND/OR OFFSET," the entire disclosure of which is hereby incorporated by reference in its entirety, and Provisional Patent Application No. 60/957,427, filed Aug. 22, 2007, entitled "AGGREGATE CUTTING SAW CHAIN," the entire disclosure of which is hereby incorporated by reference in its entirety.

TECHNICAL FIELD

The present invention relates to the field of saw chains, and in particular to a saw chain having one or more links with foot portion with an offset feature.

BACKGROUND

Chain saws typically include an endless saw chain disposed to articulate around a saw bar comprising various coupled links including cutter links, drive links, and tie straps. The cutter links and tie straps are typically in sliding engagement on bar rails of the saw bar. The cutter links can be used for cutting wood, concrete, ice and other materials.

The cutter links and tie straps which ride on the saw bar rails are generally sized to match the bar rail width/thickness. This allows the bar rail and the respective bottoms of the cutter links and tie straps to wear against each other evenly and keep one or the other from getting a non-worn area known as a "knife edge". A knife edge is undesirable because it can cause tight joints or burrs or be a source of crack initiation.

The kerf of the saw chain is generally the width of the cut that a chain makes as it cuts through material. It is controlled by the distance from the farthest outside offset dimension of the cutting portion of the cutter link on respective opposite sides of the chain. Making the kerf of the chain as narrow as possible is desirable to minimize the power necessary for cutting. Prior attempts to narrow the Kerf, however, has generally resulted in 1) knife edging occurring on the bar rails and/or the links by using thinner chain components; 2) an unacceptable decrease of kerf to bar clearance; 3) weakening of and/or limiting the length of the bar by virtue of narrowing the bar in conjunction with narrowing the components and/or to maintain a satisfactory kerf to bar clearance; and 4) reducing the cutter offset, which undesirably reduces the amount of clearance between the kerf wall and the bar, thereby negatively affecting the chip flow up the side of the bar and chain.

BRIEF DESCRIPTION OF THE DRAWINGS

Embodiments of the present invention will be readily understood by the following detailed description in conjunction with the accompanying drawings. Embodiments of the invention are illustrated by way of example and not by way of limitation in the figures of the accompanying drawings.

DESCRIPTION OF THE PREFERRED EMBODIMENTS

Figure 1:
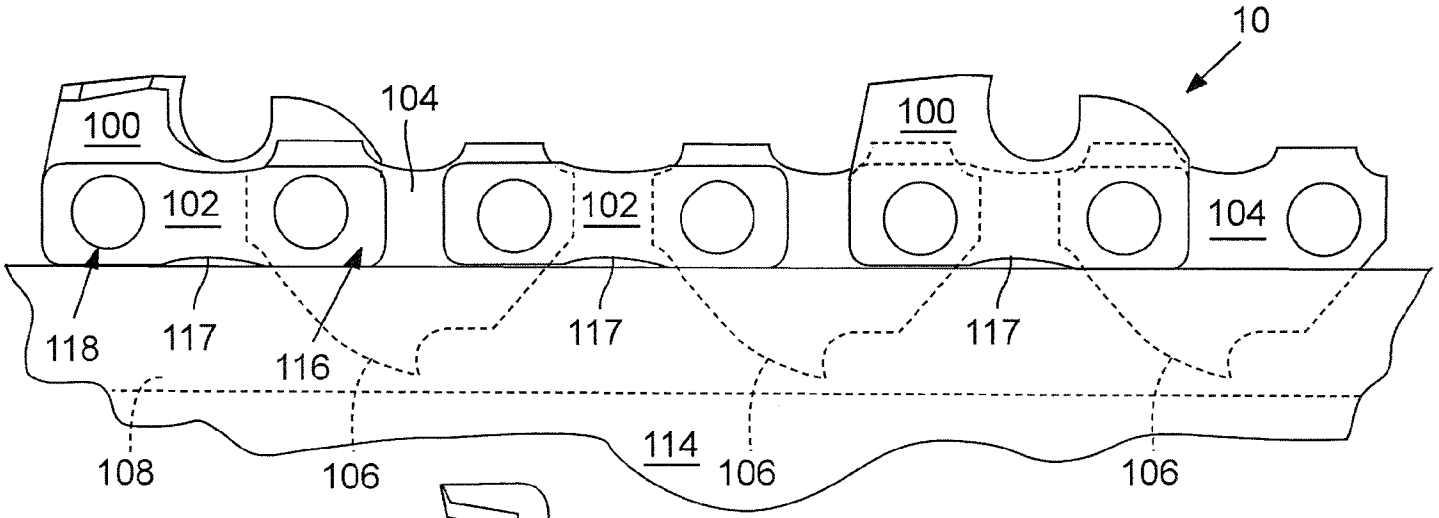
FIG. 1 illustrates a side view of a portion of a saw chain in accordance with various embodiments of the present invention.

In the following detailed description, reference is made to the accompanying drawings which form a part hereof, and in which are shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

Embodiments in accordance with the invention provide a saw chain that may help to reduce power consumption, improve performance, and/or efficiency when cutting material, such as wood, concrete, and the like. In various embodiments, the rail engaging components, such as cutter links and/or tie straps may have an offset foot print, either within the link itself and/or among multiple links. Embodiments in accordance with the invention may provide a cutting chain that also allows for a bar thickness that is practical for the desired cut length (e.g. >20 inches), while still utilizing a thinner chain width. Such an offset may have a number of uses, including, but not limited to allowing the use of narrower chain components without decreasing the bar width or cutter portion width, resist knife edging on bar rails that are wider than the thickness of a link, providing space for transporting and/or depositing lubricant (such as water or oil) onto the bar rail itself, and allow for improved penetration of the drive sprocket into the chassis of the chain without the need to include strength sacrificing notches in the link.

Figure 2:
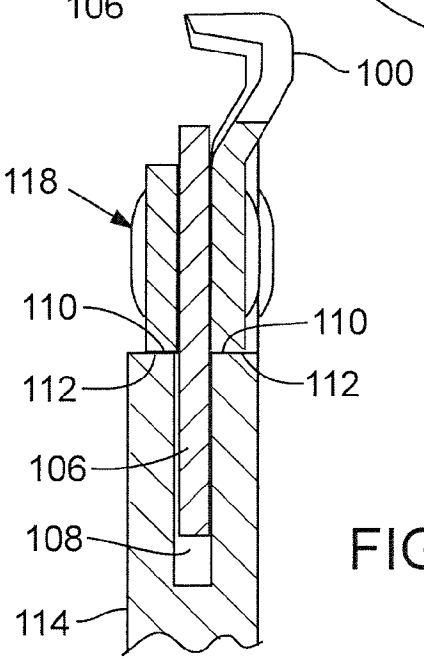
FIG. 2 illustrates a cross-sectional view of FIG. 1 in accordance with various embodiments of the present invention.

FIG. 1 illustrates a side view and FIG. 2 illustrates an end view of a saw chain in accordance with various embodiment of the invention. Saw chain 10 may be comprised of a variety of links, including, for example, cutter links 100, tie straps 102 and drive links 104, that are coupled together. Saw chain 10 may be adapted to circumnavigate guide bar 114. Tangs 106 of drive link 104 may ride in groove 108. Tie straps 102 and cutter links 100 may have a bottom or foot 110 that rides on rails 112 of guide bar 114, either of which may be referred to herein as a rail engaging link or rail riding link.

In various embodiments, the foot print of the individual rail engaging link (e.g. tie strap 102 or cutter link 100) may have an offset feature and/or configuration within the footprint from a first portion of the foot to a second portion of the foot (referred to herein as an internal offset). In one embodiment, a link first portion 116 and a link second portion 118 may be separated by a notch 117. The link first portion 116 may be offset towards the outer portion of the rail 110, while the link second portion 118 may be offset towards the inner portion of the rail 110. Other embodiments may include an opposite configuration for offsetting the footprint.

In various embodiments, the offset of the link foot print may be from rail engaging link to rail engaging link, which is referred to herein as alternating offset. In one embodiment, for example, the first portion and the second portion of a first rail engaging may be the same and offset to a first portion of the bar rail (e.g. offset towards the inner portion of the bar rail), and a second or trailing rail engaging link may have a first portion and a second portion having a footprint that is offset towards a second portion of the bar rail (e.g. offset towards the outer portion of the bar rail). In various embodiments, such an alternating offset foot print may help ensure generally even wear on the rail.

Figure 3A:
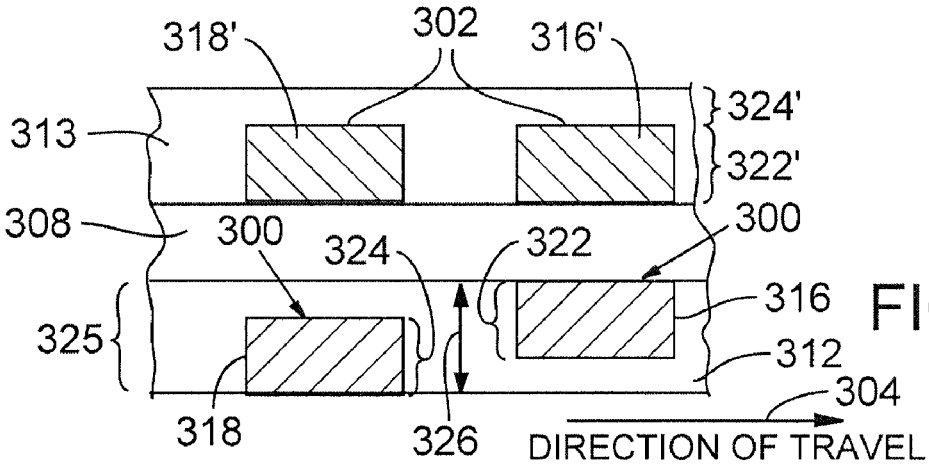
FIGS. 3A-3J illustrate a top sectional views of a rail engaging link in accordance with various embodiments of the present invention.

FIG. 3A is a partially sectioned top view taken at a horizontal sectional plane illustrating various embodiments of rail riding links having an offset footprint according to the invention. A saw chain may have a first rail engaging link 300 and a second opposing rail riding link 302. First rail riding link 300 may include a first foot portion 316 adapted to contact a first guide bar rail 312 at a first rail portion 322, which as illustrated is an inner portion of the rail. Rail riding link 300 may also have a second foot portion 318 adapted to contact the saw bar rail 312 at a second rail portion 324, which as illustrated is an outer portion of the guide bar rail. The overall link width 325 as defined by the area covered by the first portion and the second portion may be sized such that as the first rail engaging link traverses the guide bar 312 in the direction of travel 304, the entire surface of rail 312 may be engaged by either the first portion and/or the second portion to help ensure the rail surface is worn at a relatively even rate.

In various embodiments, second rail engaging link 302 may be disposed to engage a second guide bar rail 313, which may be disposed on an opposite side of groove 308 from first guide bar rail 312. Second rail engaging link 302 may be, for example, an opposing tie strap, and illustrates an alternating offset footprint in accordance with various embodiments. Both the forward portion 316' and rearward portion 318' may be offset towards a first portion 322' of guide bar rail 313, for example by virtue of being narrower or thinner in configuration to help improve efficiency. A leading and/or trailing rail engaging link (not shown) may have a forward portion and rearward portion having the same offset, but rather directed towards the outer portion 324' of rail 313.

As discussed, FIG. 3A illustrates two different examples of offset footprints in accordance with various embodiments, i.e. an offset footprint within the rail engaging link itself (internal offset) and an offset footprint with respect to leading and/or trailing rail engaging footprints (generally referred to herein as alternating offset). Saw chains in accordance with various embodiments may include rail engaging links having only an internal offset, an alternating offset, or a combination of both. Further, in various embodiments the width covered by the first portion and the second portion may define the overall rail engaging link width, and may generally correspond to the width of the guide bar rail. In various embodiments, the width of the link first portion and width of the link second portion may overlap, such that the entire width of a guide bar rail may still be covered.

Figure 3B:
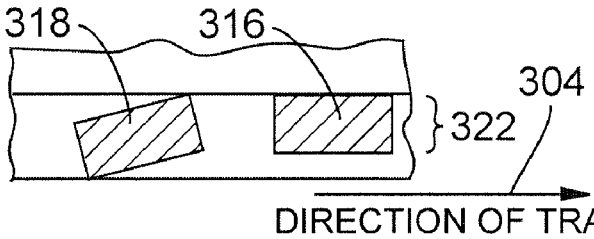
Figure 3C:
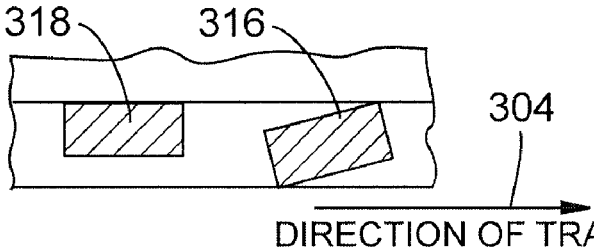
Figure 3D:
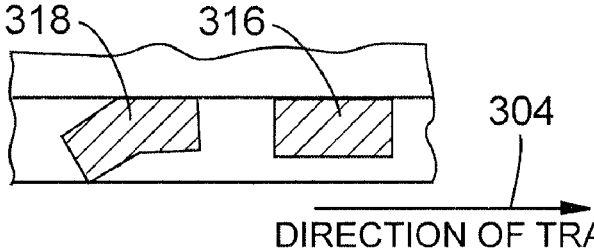
Figure 3E:
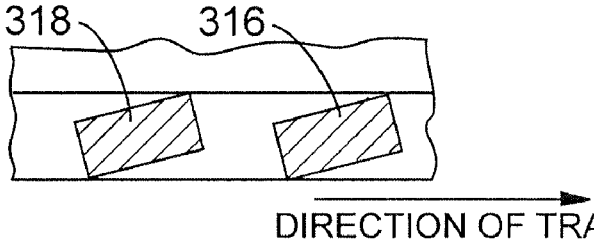
Figure 3F:
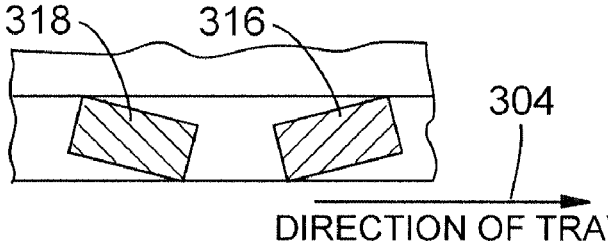
Figure 3G:
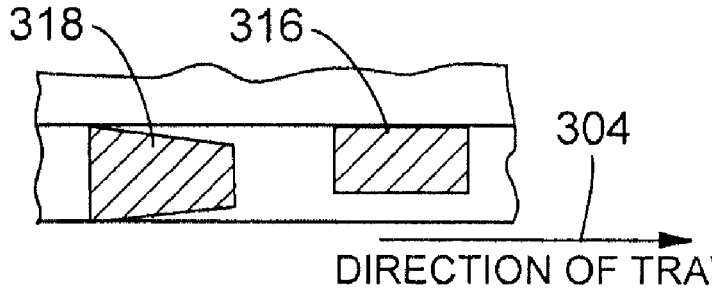
Figure 3H:
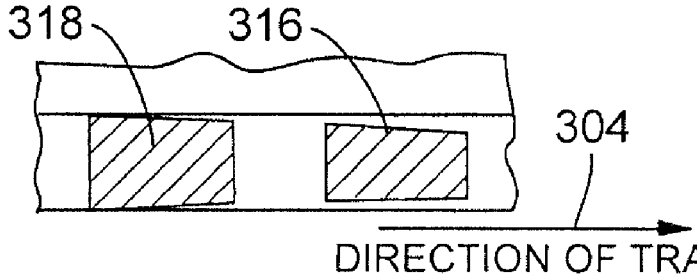
Figure 3I:
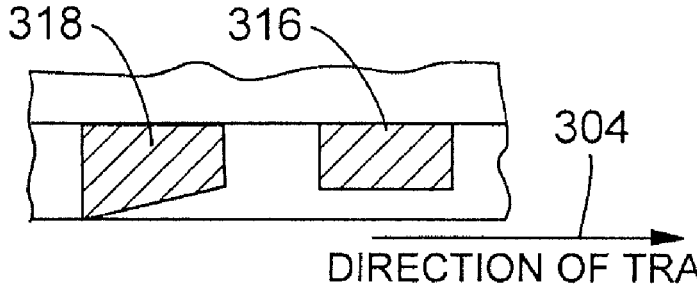
Figure 3J:
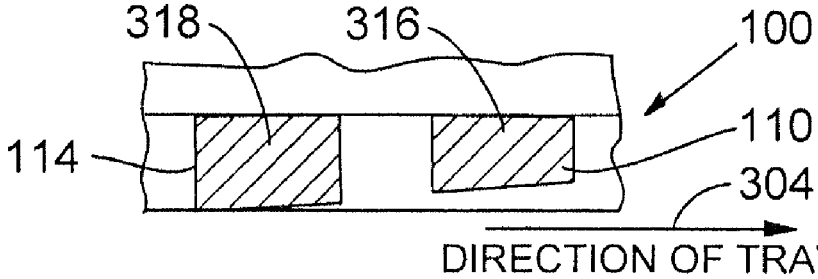

FIGS. 3B through 3J are top partial sectional views illustrating various other embodiments of an internal offset foot print for rail engaging links. FIG. 3B illustrates a forward portion 316 being offset towards an inner portion 322 of the guide bar rail 312 and a rearward portion 318 having a skewed offset with respect to the direction of travel 304 (e.g. bent at an angle relative to the forward portion). FIG. 3C illustrates the leading portion 316 being skewed with respect to the direction of travel 304. FIG. 3D illustrates the second portion 318 having a partially skewed section that covers the sum of the width of the guide bar rail. FIGS. 3E and 3F illustrate embodiments where both the first portion 316 and the second portion 318 are skewed with respect to the direction of travel 304. FIGS. 3G through 3J illustrate rail engaging link foot prints wherein one or both of the first portion 316 and second portion 318 are tapered in thickness. In various embodiments, the offset can be uniform or it can be an angled offset so that the offset goes from zero to a full offset from, for example, the front portion to the rear portion, or from the middle portion to the rear portion of the footprint.

Figure 4A:
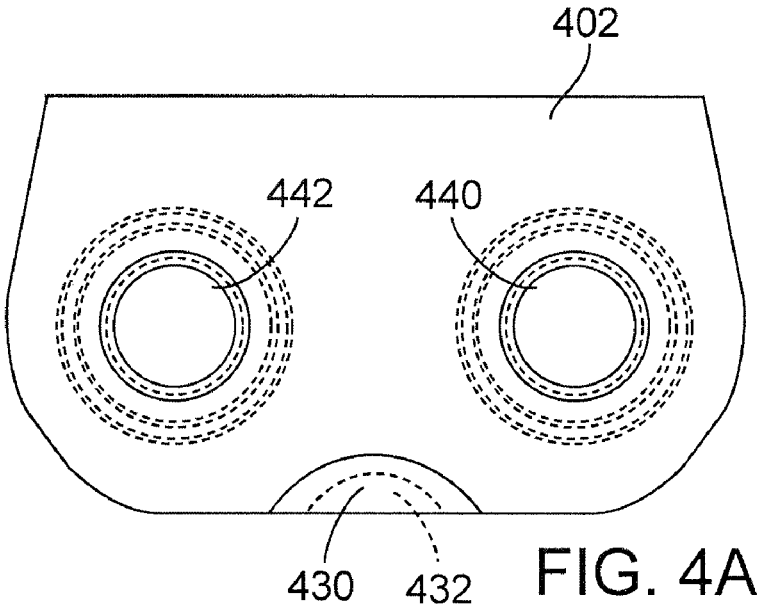
FIGS. 4A-4C illustrate a side, bottom and partial sectional end view of a rail engaging link in accordance with various embodiments of the present invention.
Figure 4B:
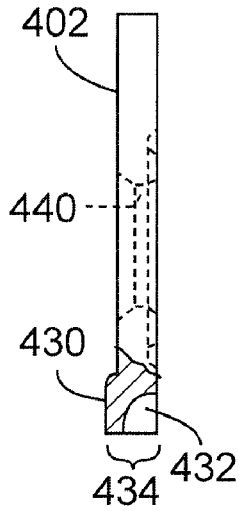
Figure 4C:
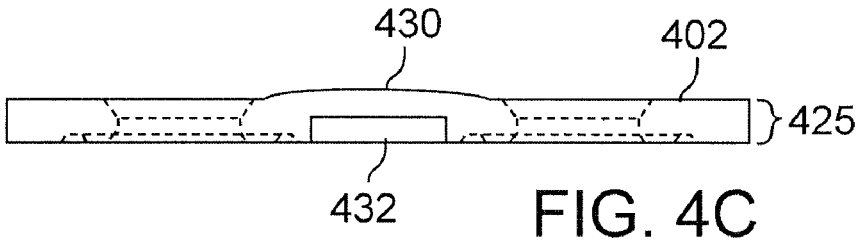

FIGS. 4A through 4C illustrate side, partial end section and top views of a rail engaging link having an internal offset in accordance with various embodiments. Rail engaging link 402 (e.g. tie strap, cutter link, etc.) may have a rail engaging bottom 410 adapted to ride along a guide bar rail (not shown) during a cutting operation. Rail engaging bottom 410 may have an offset foot print by way of including an offset feature 430 disposed within the length of the bottom 410. In various embodiments, offset feature 430 may define the second portion of the footprint, while the leading portion, trailing portion, or both may define the first portion of the link. In various embodiments, rail engaging bottom 410 may be adapted to generally engage the guide bar rail along the entire length of the bottom 410, such that offset feature 430 may include a cavity 432. Cavity 432 may be large enough such that the overall link width 434 of the rail engaging link 402 may be generally the same as the width of the rail upon which it rides (not shown). Such a configuration may help prevent knife edging.

In various embodiments, offset feature 430 may help carry lubricating fluid (e.g. oil, water, etc.) for distribution along the path of travel. In various embodiments, fluid carried by the cavity 432 of offset feature 430 may be directly deposited onto the guide bar rail at the wear interface, thereby lubricating the rail for the rail engaging links. Such enhanced lubrication may improve chain longevity, as well as improve performance and efficiency as the additional lubrication of the rail helps resist rail wear, which in turn helps reduce the power input required for the same abrading activity.

In various embodiments, offset feature 430 may be disposed anywhere along the link bottom 410. In some embodiments, the offset feature 430 may be disposed generally in the central portion of the link 402, e.g. between the center axis of the rivet holes 440 and 442. In such an embodiment, the cavity 432 of the offset feature 430 may allow for improved penetration of a drive sprocket tooth into the chassis of the chain. Such a configuration may have the benefit of allowing for thinner, but generally stronger chain to be used, as the links such as tie straps would not need to include the typical notch/cut out to allow drive sprocket tooth penetration. Further, in various embodiments, a narrower link body could be used to again improve efficiency of the cutting chain and reduce power demands.

Figure 5:
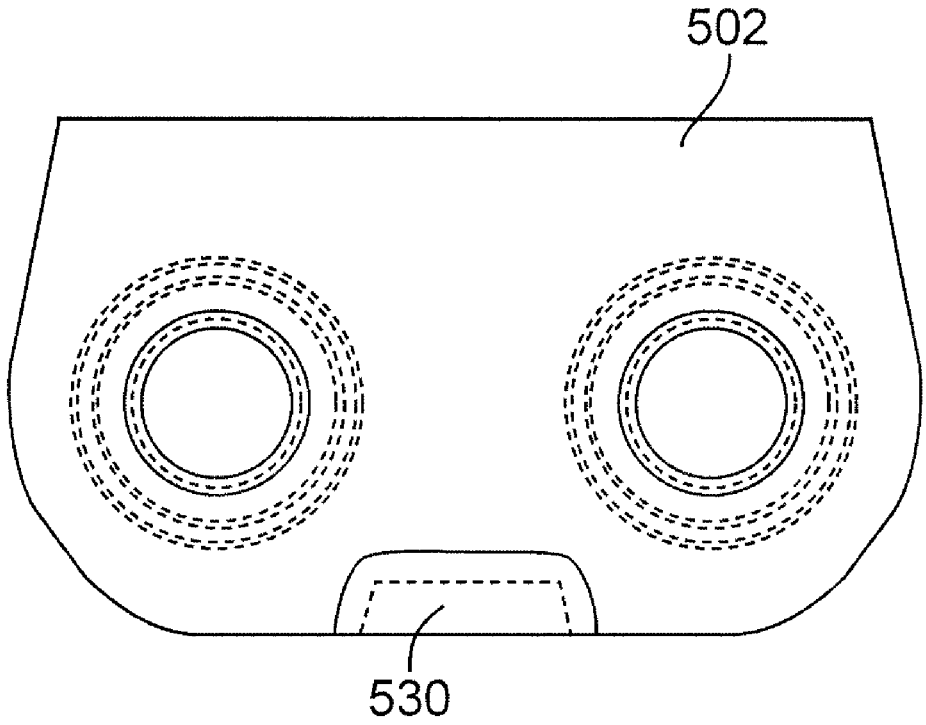
FIG. 5 illustrates a side view of a rail engaging link in accordance with various embodiments of the present invention.
Figure 6:
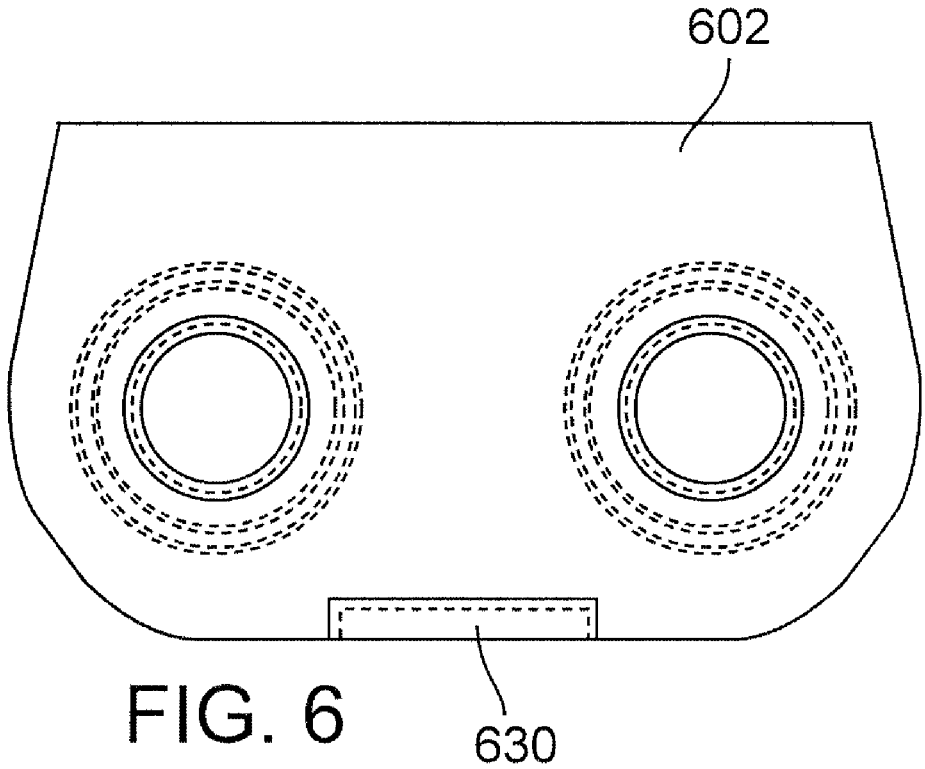
FIG. 6 illustrates a side view of a rail engaging link in accordance with various embodiments of the present invention.

FIG. 5 and FIG. 6 illustrate side views of a rail engaging links 502 and 602 having an offset footprint in accordance with various embodiments. These figures illustrate that the offset feature 530 and 630 may be of a variety of geometric configurations. In other embodiments, the configuration of the offset feature and the depth of the cavity created by the offset feature may be varied depending on the application and desired result (e.g. prevent knife edging, fluid carrying capacity, drive sprocket tooth penetration and/or reduce material thickness/weight).

Figure 7A:
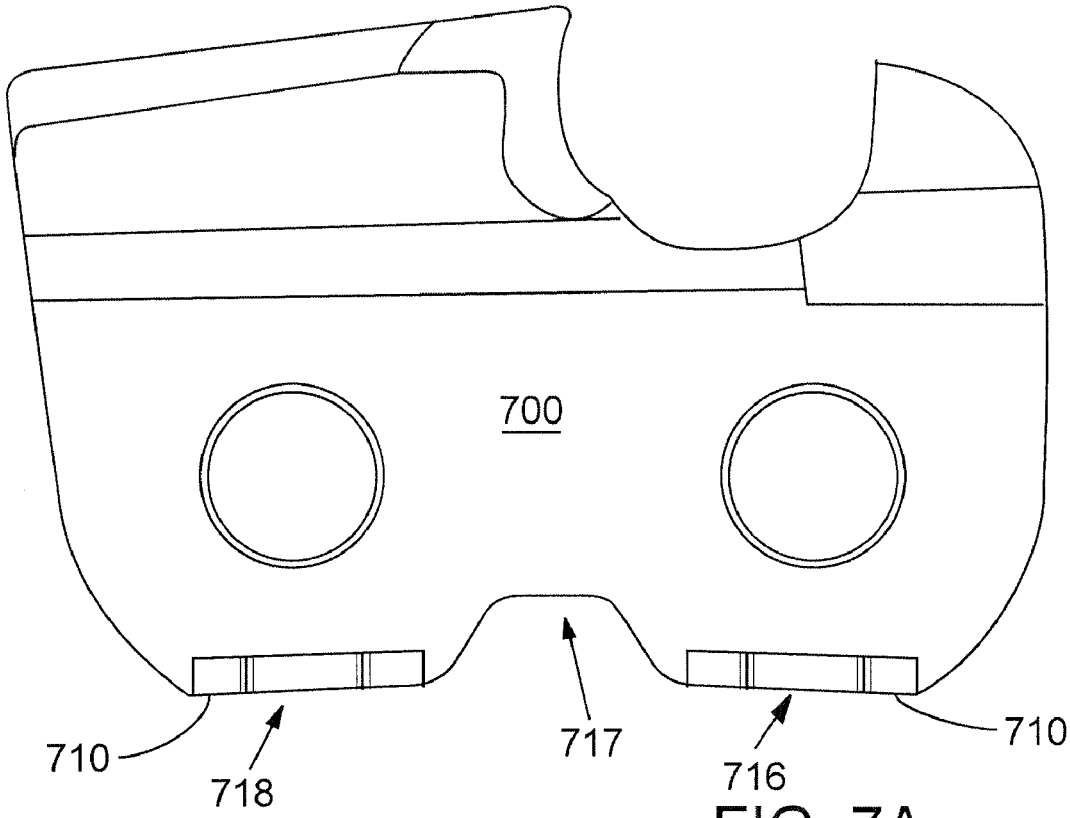
FIGS. 7A and 7B illustrate side and bottom views of a rail engaging link in accordance with various embodiment of the present invention.
Figure 7B:
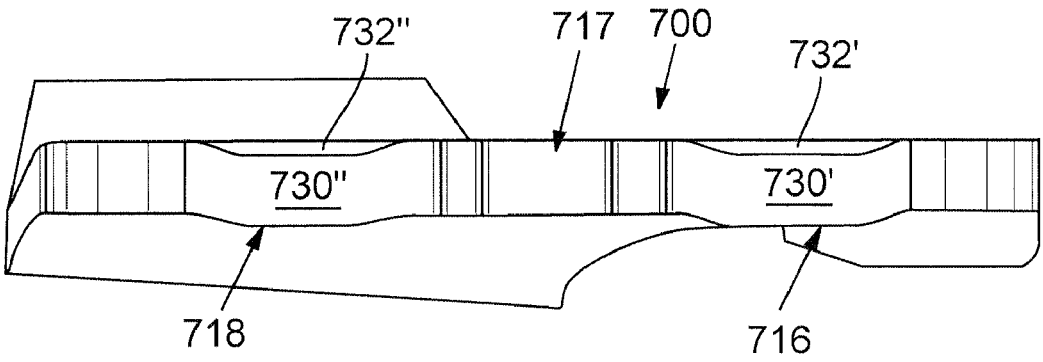

FIGS. 7A and 7B illustrate a side view and a bottom view of a rail engaging link in accordance with various embodiments. Rail engaging link 700 may include a first portion 716 and a second portion 718 separated by a notch 717. First portion 716 and a second portion 718 include a bottom 710 adapted to engage a guide bar rail (not shown). First portion 716 may have a first offset feature 730' thereby forming a first portion cavity 732'. Second portion 718 may have a second offset feature 730" thereby forming a second portion cavity 732". In various embodiments, either the first portion 716 and/or the second portion 718 may include an offset feature.

Various embodiments may include saw chains having a mix of cutter links and/or tie straps, some or all of which may have an offset footprint. Further, the offset may be an internal offset and/or an alternating offset. In various embodiments, the rail engaging link offset may be formed in the rail engaging link in a variety of ways, such as pressing, bending, coining, stamping, etc.

In addition to the discussion and illustrations of various embodiments above, it is to be understood, however, that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein.

What is claimed is:

1. A saw chain comprising:

a drive link for riding in a groove of a guide bar, wherein the groove is disposed between a first rail and a second rail of the guide bar; and a rail engaging link, coupled to the drive link, for traversing the first rail of the guide bar in a direction of travel, the rail engaging link including a first foot portion for contacting the first rail with a first footprint and a second foot portion for contacting the first rail with a second footprint, wherein the first footprint is laterally offset from the second footprint with respect to the direction of travel; and Wherein the first foot portion is a leading foot portion, and the second foot portion is a trailing foot portion, and wherein at least a portion of the rail engaging link between the leading foot portion and the trailing foot portion does not contact the first rail of the guide bar as the rail engaging link traverses the first rail.

2. The saw chain of claim 1, wherein the first footprint has a shape and an area substantially similar to a shape and an area, respectively, of the second footprint.

3. The saw chain of claim 1, wherein the first foot portion and the second foot portion do not individually contact substantially a total width of the first rail as the rail engaging link traverses the first rail, and further wherein the first foot portion and the second foot portion combine to contact substantially the total width of the first rail as the rail engaging link traverses the first rail.

4. The saw chain of claim 1, wherein the first footprint and/or the second footprint are skewed with respect to a direction of chain travel.

5. The saw chain of claim 1, wherein the first footprint has a shape that is different than a shape of the second footprint.

6. The saw chain of claim 1, wherein the first foot portion and the second foot portion are separated by a notch.

7. The saw chain of claim 1, wherein a cavity is formed between the first foot portion and the second foot portion, and wherein the cavity is configured to distribute a lubricating fluid along a path of travel.

8. The saw chain of claim 7, wherein the cavity is disposed generally between a central axis of two rivet holes of the rail engaging link.

9. The saw chain of claim 1, further comprising a second rail engaging link, wherein the second rail engaging link includes an offset footprint.

10. The saw chain of claim 9, wherein the second rail engaging link sequentially follows the rail engaging link.

11. The saw chain of claim 1, wherein the rail engaging link is a cutting link or a tie strap.

12. The saw chain of claim 1, further comprising a second rail engaging link coupled to the first rail engaging link, wherein the second rail engaging link is configured to engage the second rail of the guide bar.

13. The saw chain of claim 12, wherein the second rail engaging link includes a first foot portion configured to engage a first portion of the second rail and a second foot portion configured to engage the first portion of the second rail.

14. The saw chain of claim 12, wherein the second rail engaging link includes a first foot portion configured to engage a first portion of the second rail and a second foot portion configured to engage a second portion of the second rail, wherein the first portion of the second rail is different than the second portion of the second rail.

15. A saw chain comprising:

a drive link for riding in a groove of a guide bar, wherein the groove is disposed between a first rail and a second rail of the guide bar; and a rail engaging link, coupled to the drive link, for traversing the first rail of the guide bar in a direction of travel, the rail engaging link including a first foot portion for contacting the first rail with a first footprint and a second foot portion for contacting the first rail with a second footprint, wherein the second footprint is laterally offset and/or skewed from the first footprint with respect to the direction of travel; and wherein the first foot portion is a leading foot portion, and the second foot portion is a trailing foot portion, and wherein at least a portion of the rail engaging link between the leading foot portion and the trailing foot portion does not contact the first rail of the guide bar as the rail engaging link traverses the first rail.

16. The saw chain of claim 15, wherein the first footprint has a shape and an area substantially similar to a shape and an area, respectively, of the second footprint.

17. The saw chain of claim 15, wherein the first foot portion and the second foot portion do not individually contact substantially a total width of the first rail as the rail engaging link traverses the first rail, and further wherein the first foot portion and the second foot portion combine to contact substantially the total width of the first rail as the rail engaging link traverses the first rail.

18. The saw chain of claim 15, wherein the first footprint has a shape that is different than a shape of the second footprint.

* * * * *